US007091809B2

(12) United States Patent
vom Schloss et al.

(10) Patent No.: US 7,091,809 B2
(45) Date of Patent: Aug. 15, 2006

(54) SEALING OF AN IGNITION COIL

(75) Inventors: Andreas vom Schloss, Gaimersheim (DE); Bernhard Stock, Adelschlag (DE)

(73) Assignee: Audi AG (DE)

( * ) Notice: Subject to any disclaimer, the term of this patent is extended or adjusted under 35 U.S.C. 154(b) by 60 days.

(21) Appl. No.: 10/616,987

(22) Filed: Jul. 11, 2003

(65) Prior Publication Data

US 2004/0056746 A1 Mar. 25, 2004

(30) Foreign Application Priority Data

Jul. 12, 2002 (DE) ..... 102 31 510

(51) Int. Cl.
*H01F 27/02* (2006.01)

(52) U.S. Cl. ..... 336/90; 336/96

(58) Field of Classification Search ..... 336/90–96, 336/107, 192; 123/634–635
See application file for complete search history.

(56) References Cited

U.S. PATENT DOCUMENTS

| | | | | |
|---|---|---|---|---|
| 3,716,038 | A * | 2/1973 | Bevacqua | 123/634 |
| 5,324,207 | A * | 6/1994 | Itoh et al. | 439/125 |
| 5,547,387 | A * | 8/1996 | Kobayashi | 439/125 |
| 5,842,458 | A | 12/1998 | Alstrin et al. | 123/635 |
| 6,114,935 | A * | 9/2000 | Oosuka et al. | 336/107 |
| 6,208,231 | B1 | 3/2001 | Oosuka et al. | 336/107 |
| 6,525,636 | B1 * | 2/2003 | Oosuka et al. | 336/90 |

* cited by examiner

*Primary Examiner*—Tuyen T Nguyen
(74) *Attorney, Agent, or Firm*—Stevens, Davis, Miller & Mosher, LLP

(57) ABSTRACT

The winding (3) of an ignition coil device (1) is to be better sealed in order to afford it more protection from fouling, moisture, and reagents of all kinds. Provision is accordingly made such that there is introduced between a winding element (2) and an outer metal jacket (5) a rubber insulating element (7) having a sealing profile (8). As a result, improved sealing from the winding element (2) and the outer metal jacket (5) is provided. As an alternative, provision may be made such that the insulating element (7) including a sealing compound (10) is introduced between the outer metal jacket (5) and the winding element (2).

20 Claims, 1 Drawing Sheet

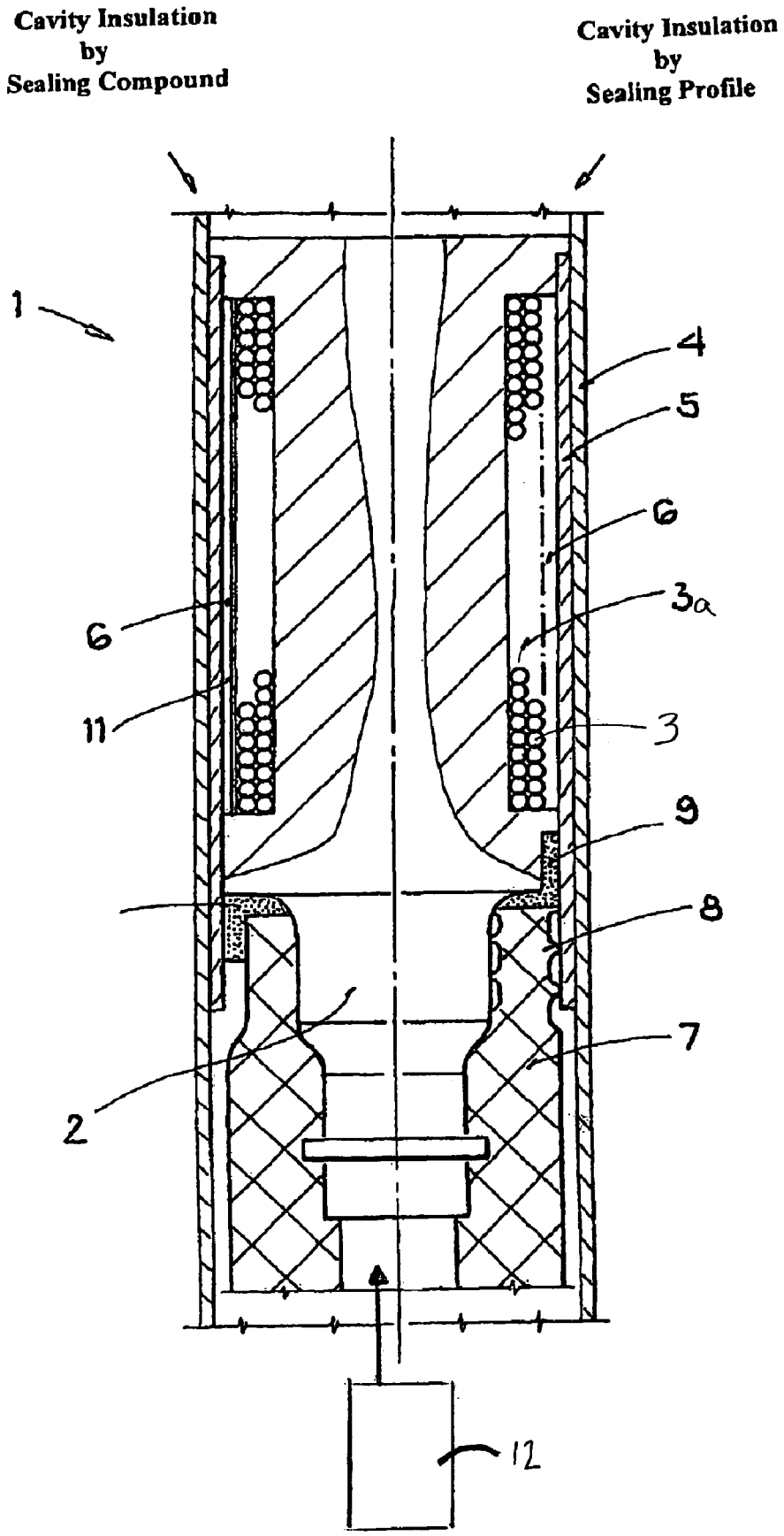
Cavity Insulation
by
Sealing Compound
Cavity Insulation
by
Sealing Profile
1
4
5
6
3a
6
11
3
9
8
7
2
12

SEALING OF AN IGNITION COIL

BACKGROUND OF THE INVENTION

This invention relates to an ignition coil device for igniting a fuel mixture in an internal combustion engine having a winding element mounted on a coil winding cylindrical in shape which may be connected to a spark plug, a sheet metal jacket circumferentially enclosing the winding element with coil winding, and an elastic insulating element in the form of a hollow cylinder which is mounted on a section of the winding element facing the spark plug for insulation against high voltage.

Rod ignition coils are used to generate high voltage for igniting a fuel mixture in an internal combustion engine. A rod ignition coil represents a high-voltage transformer whose magnetic circuit consists of a main core enclosed in a secondary or primary coil, in which core there may be an air gap, and of ground legs or yoke elements. In the case of rod ignition coils the magnetic ground is completed by the housing made up of bent electric sheeting. The primary winding of the rod ignition coil is supplied with suitable current by way of control electronics. The control electronics interrupt the primary current, as a result of which a high-voltage is generated on the secondary side to impinge on an ignition coil mounted on the rod ignition coil.

The rod ignition coil is normally cast in the interior of the housing by injection of an electrically insulating sealing compound. This casting serves the purpose of immobilizing in their desired position the components mounted inside the housing, such as the soft magnetic core and the coil element with primary and secondary coil, without the need for additional retaining means. In order to prevent interior stresses caused by the casting compound, the inner wall of the housing may be coated with an elastic medium and the gap between the elastic medium and the components mounted inside the housing may be coated with an electrically insulating resin. Consequently, thermal expansion which may result in formation of cracks in the interior of the housing may be prevented.

In order to avoid this additional production engineering expense of elastic coating, German patent DE 199 27 820 C1 discloses hollowing out of the casting compound inside the rod ignition coil body in the area between the outer winding and the housing. As a result, the winding should be able to undergo thermal expansion during heating so that internal stresses do not occur. Provision is made such that a connecting section of flexible material impervious to high voltage is used which covers the rod ignition coil and the spark plug; this connecting section has on the ignition coil side a coupling section in the area of which the housing and at least one of the two coil elements are elastically interconnected. The elastomer material of the connecting section is sprayed around and mounted around one of the two coil elements in the area between housing and coil element exterior. A section absorbing expansion or stresses is consequently formed at the point at which the outer annular space is formed. It is also specified in this document that an elastomer connection empties directly into the area between the housing and the outer coil element, so that the two components are interconnected by way of the elastic medium. The elastic medium is thus inserted below the housing. As a result, the housing is both centered and sealed.

Sealing of cavities in the rod ignition coil is disclosed, for example, in German patent DE 197 02 438 C2.

Sealing of the primary coil from environmental effects is needed in particular to prevent corrosion of the primary winding. Consequently, the effect of sealing from moisture, fouling, and reagents of all kinds is to be achieved.

SUMMARY OF THE INVENTION

The object of this invention is to improve the sealing of an ignition coil from its environment.

It is claimed for this invention that this object is attained by an ignition coil device for igniting a fuel mixture in an internal combustion engine, one having a winding element on which is wound a winding which is cylindrical in shape and which may be connected on a frontal surface to a spark plug, a sheet metal jacket which encloses the winding element with the coil winding circumferentially, and an elastic element insulating from high voltage, which is in the form of a hollow cylinder and which is mounted on a section of the winding element on a section of the winding element facing the frontal surface and is mounted at least in part between the winding element and the sheet metal jacket, the elastic insulating element and/or winding element having a sealing profile in the area in which the elastic insulating element is mounted between the winding element and the sheet metal jacket.

In addition, it is claimed for the invention that the object as formulated in the foregoing is attained by an ignition coil device for igniting a fuel mixture in an internal combustion engine, one having a winding element on which is wound a coil winding which is cylindrical in shape and which may be connected on a frontal surface to a spark plug, a sheet metal jacket which encloses the winding element with coil winding circumferentially, and an elastic insulating element for insulation from high voltage which is cylindrical in shape and which is mounted on a section of the winding element facing the frontal surface and at least in part between the winding element and the sheet metal jacket, a cavity between the elastic insulating element and the sheet metal jacket being filled with sealing compound.

Hence it is possible, with a closed outer shell or continuous sheet metal jacket, to seal the unfilled primary winding cavity with a rubber insulating element or other elastic insulating element. Consequently, an insulating sheet and optional subsequent sealing of the primary winding cavity may be dispensed with. At the same time, a certain degree of mechanical strength of the insulation is obtained with this type of insulation of the primary winding from the external sheet. Since it is not absolutely necessary to fill the cavity, the curing times required after casting are eliminated.

It is advantageous for the primary winding to be wound on the winding element and for the secondary winding to be situated inside the winding element. Since lower voltages are applied to the primary winding than to the secondary winding, the cavity arising at the primary winding element need not be filled with an electrically insulating material. The secondary winding inside the primary winding element, on the other hand, is normally filled by casting.

In addition to the elastic insulating element, a casting compound may be introduced between the winding element and the external metal sheet. This measure makes it possible to increase or supplement the sealing effect of the elastic insulating element. This is of particular advantage at places which are very narrow and into which an elastic insulating element may no longer be introduced.

The cavity between the coil winding and the outer metal sheet serves primarily to permit thermal expansion of the coil winding. Specific dimensions may be assigned to this cavity because of the sealing elastic insulating element, something not immediately possible with casting technology.

The sheet metal jacket preferably comprises a plurality of sheets mounted radially one over the other. They make more effective magnetic reflux possible and should be made of a suitable ferromagnetic material.

The sheet metal jacket preferably extends axially not only over the primary winding and the sealing area of the elastic insulating element but also more or less over the entire elastic insulating element. This provides increased mechanical strength and increased mechanical protection of the ignition coil in this area.

The sealing of the primary winding may be additionally increased in that an insulating sheet or shrunk-on plastic tubing is mounted on the surface of the coil winding under the sheet metal jacket. While this measure makes the insulation very costly, it may result in increase in the service life of the ignition coil device.

BRIEF DESCRIPTION OF THE DRAWING

The elastic insulating element preferably is sprayed on or secured by adhesive to the primary winding element. This affords the advantage that the elastic insulating element is rigidly connected to the primary winding element and need not be permanently retained by the sealing profile or sealing subsequently applied to the primary winding element.

DETAILED DESCRIPTION OF THE INVENTION

The present invention will now be explained in detail with reference to the attached drawing, which presents a cross-section through an ignition coil device as claimed for the invention.

The exemplary embodiment specified in what follows represents a preferred embodiment of this invention.

The FIGURE illustrates an ignition coil 1 with two versions of cavity insulation. The cavity insulation in the form of rubber element and sealing compound claimed for the invention is shown in the left half of the FIGURE and the cavity insulation in the form rubber element and sealing profile in the right half. An essential component in the interior of the ignition coil 1 is the primary winding element 2, which extends in the axial direction of the cylindrical ignition coil 1 over the entire length of the illustration in the drawing. The primary winding 3 is wound on a narrowed area of the primary winding element 2. External sheet metal cylinders 4 and 5 are pushed concentrically over the primary winding element 2, which primary winding element is electrically connectable to a spark plug 12 positioned in a hollow portion of insulating element 7 and between the winding element and the sheet metal jacket. Since the space required by the primary winding does not fill the entire volume of the narrowed area in the primary winding element 2, a cavity 6 remains between the primary winding and the interior of the two external metal cylinders 5. This cavity makes it possible for the primary winding to expand when subjected to a high current load.

A rubber insulating element 7 is provided on the bottom of the primary winding element 2 for high-voltage insulation. This rubber insulating element 7 is also in the form of a hollow cylinder and has an inner outline which more or less corresponds to the outer outline of the lower part of the primary winding element 2. An insulating element of any elastomer desired or another elastic material may be used as an alternative to the rubber insulating element 7.

The rubber insulating element 7 has a sealing profile with elastic projections in the section facing the primary winding 3. These elastic projections press inward on one side against the primary winding element 2 and on the other press outward against the metal jacket 5. As a result, the outer cylinder 5 is sealed from the winding element 2 and at the same time the cavity 6 is sealed from the external environment. As an alternative, the sealing profile could also be part of the primary winding element 2. In this instance the projections of the sealing profile would also press into the elastic insulating element 7 and in addition achieve a sealing effect (not shown in the FIGURE).

In addition to sealing by the sealing profile 8, the cavities between the between the primary winding element 2 and the inner exterior jacket 5 may be sealed with sealing compound 9. The desired effect of sealing from moisture, fouling, and reagents of all types which may cause corrosion of the primary winding is accordingly improved.

As is shown in the left half of the drawing, sealing in accordance with a second embodiment is effected not by means of a sealing profile but by means of the rubber insulating element 7 inserted with clearance between the inner jacket 5 and the primary winding element 2 and subsequent introduction of sealing or adhesive compound 10 into the cavity between rubber insulating element 7, primary winding element 2, and outer jacket 5. In this embodiment the primary winding element 2 is immediately adjacent to the metal jacket 5 in the area between primary winding 3 and rubber insulating element 7. A secondary winding 3*a* is positioned inside the primary winding 3.

Additional sealing of the primary winding 3 may be provided in the case of this alternative embodiment as well. It consists of applying an insulating sheet or a shrunk-on tube 11 on the primary winding 3.

The invention claimed is:

1. An ignition coil for igniting a fuel mixture in an internal combustion engine having a winding element on which is wound a coil winding which is in the form of a cylinder and which may be connected to a spark plug on its frontal surface, a sheet metal jacket which encloses the winding element with the coil winding on its circumference, and an elastic insulating element for insulation from high voltage which is in the form of a hollow cylinder mounted on the winding element on a section facing the frontal surface of such winding element, the winding element being electrically connectable to a spark plug with a terminal of said spark plug received in the hollow portion thereof and having at least a part of the spark plug disposed between the winding element and the sheet metal jacket, characterized in that at least one of the elastic insulating element and the winding element has a sealing profile in the area in which the elastic insulating element is mounted between the winding element and the sheet metal jacket and a sealing compound disposed between the winding element and the sheet metal jacket.

2. An ignition coil device for igniting a fuel mixture in an internal combustion engine having a winding element on which is wound a coil winding which winding element is cylindrical in shape and which may be connected on a frontal side to a spark plug, a sheet metal jacket which encloses the winding element with the coil winding on its circumference, and an elastic insulating element for insulation from high voltage which is in the form of a hollow cylinder, mounted on the winding element on a section of such winding element facing the frontal surface, the winding element being mounted on a spark plug with a terminal of said spark plug received in the hollow portion thereof and having at least in part disposed between the winding element and the sheet metal jacket, characterized in that a cavity between the elastic insulating element and the sheet metal jacket is filled with a sealing compound.

3. The ignition coil device as claimed in claim 1, wherein the elastic insulating element comprises an elastomer and is applied by spraying to the winding element.

4. The ignition coil device as claimed in claim 1, wherein the elastic insulating element is applied to the winding element by adhesion.

5. The ignition coil device as claimed in claim 1, wherein a primary winding is wound on the winding element.

6. The ignition coil device as claimed in claim 1, wherein a sealing compound is introduced between the winding element and the sheet metal jacket, in addition to the elastic insulating element.

7. The ignition coil device as claimed in claim 1, wherein a cavity extending radially is present between the coil winding and the sheet metal jacket.

8. The ignition coil device as claimed in claim 7, wherein the cavity is filled at least in part with a sealing compound.

9. The ignition coil device as claimed in claim 1, wherein one of an insulating sheet and a shrunk-on tube is mounted on an outer surface of the coil winding under the sheet metal jacket.

10. The ignition coil device as claimed in claim 1, wherein the sheet metal jacket comprises a plurality of metal plates mounted radially one above the other.

11. The ignition coil device as claimed in claim 2, wherein the elastic insulating element comprises an elastomer and is applied by spraying to the winding element.

12. The ignition coil device as claimed in claim 2, wherein the elastic insulating element is applied to the winding element by adhesion.

13. The ignition coil device as claimed in claim 2, wherein a primary winding is wound on the winding element.

14. The ignition coil device as claimed in claim 2, wherein a sealing compound is introduced between the winding element and the sheet metal jacket, in addition to the elastic insulating element.

15. The ignition coil device as claimed in claim 2, wherein a cavity extending radially is present between the coil winding and the sheet metal jacket.

16. The ignition coil device as claimed in claim 15, wherein the cavity is filled at least in part with a sealing compound.

17. The ignition coil device as claimed in claim 2, wherein an insulating sheet or a shrunk-on tube is mounted on an outer surface of the coil winding under the sheet metal jacket.

18. The ignition coil device as claimed in claim 2, wherein the sheet metal jacket comprises a plurality of metal plates mounted radially one above the other.

19. The ignition coil as claimed in claim 1 wherein at least surface of a portion of said elastic insulating element disposed between said winding element and said sheet metal jacket has a ribbed configuration.

20. An ignition coil for igniting a fuel mixture in an internal combustion engine, comprising:

a core element;

primary and secondary windings supported on said core element;

a metallic casing encompassing said windings;

a sealing compound disposed between the winding element and the casing; and an elastomeric insulating element having an opening therethrough, mountable on a spark plug with a terminal portion of said spark plug extending into said opening in electrical contact with a terminal of said secondary winding, and a portion disposed between said core element and said casing.

* * * * *